US011213089B2

(12) United States Patent
Bohn et al.

(10) Patent No.: US 11,213,089 B2
(45) Date of Patent: Jan. 4, 2022

(54) PROTECTIVE HELMET WITH FACE PROTECTION SHIELD AND LINKAGE MECHANISM

(71) Applicant: MSA Technology, LLC, Cranberry Township, PA (US)

(72) Inventors: Alexa Danielle Bohn, Pittsburgh, PA (US); Daniel Martin Hehman, Cranberry Township, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 3 days.

(21) Appl. No.: 16/431,043

(22) Filed: Jun. 4, 2019

(65) Prior Publication Data

US 2020/0383417 A1 Dec. 10, 2020

(51) Int. Cl.
*A42B 3/22* (2006.01)

(52) U.S. Cl.
CPC ..... *A42B 3/223* (2013.01)

(58) Field of Classification Search
None
See application file for complete search history.

(56) References Cited

U.S. PATENT DOCUMENTS

| | | | | |
|---|---|---|---|---|
| 1,557,375 | A | 10/1925 | Stern | |
| 2,248,331 | A | 7/1941 | Blodjer | |
| 2,934,767 | A | 5/1960 | Schoener | |
| 3,336,598 | A | 8/1967 | Aebersold et al. | |
| 3,400,407 | A | 9/1968 | Aileo | |
| 3,605,115 | A | 9/1971 | Bohner | |
| 4,100,619 | A * | 7/1978 | Piech | A42B 3/226 2/10 |
| 4,422,185 | A | 12/1983 | Cook | |
| 4,432,100 | A | 2/1984 | Bates | |

(Continued)

FOREIGN PATENT DOCUMENTS

| | | |
|---|---|---|
| DE | 29820078 U1 | 3/2000 |
| DE | 69909975 T2 | 5/2004 |

(Continued)

OTHER PUBLICATIONS

Alexa Danielle Bohn et al., Utility U.S. Appl. No. 16/207,842 entitled "Helmet with Accessory Attachment Rail", filed Dec. 3, 2018 (Applicant MSA Technology, LLC, Cranberry Township, PA).

*Primary Examiner* — Khoa D Huynh
*Assistant Examiner* — Grace Huang
(74) *Attorney, Agent, or Firm* — The Webb Law Firm

(57) ABSTRACT

A protective helmet has an outer shell, a protection shield movable relative to the outer shell between a deployed position and a stowed position, and a linkage mechanism for connecting the protection shield to the outer shell and permitting movement of the protection shield between the deployed and stowed positions. The linkage mechanism has a first link with a first end connected to the outer shell and a second end connected to the protection shield, a second link having a first end connected to the outer shell and a second end connected to the protection shield, and a biasing member having a first end connected to the first link and a second end connected to the second link. The second end of the biasing member moves between the first and second ends of the second link during movement of the protection shield between the deployed and stowed positions.

16 Claims, 7 Drawing Sheets

(56) References Cited

U.S. PATENT DOCUMENTS 4,817,596 A * 4/1989 Gallet ..... A42B 3/288 128/201.24
4,852,186 A 8/1989 Landis
4,853,973 A * 8/1989 Boochard ..... A61F 9/06 2/8.1
4,907,300 A * 3/1990 Dampney ..... A42B 3/228 2/424
5,365,615 A 11/1994 Piszkin
5,546,610 A 8/1996 Herzig et al.
D375,583 S 11/1996 Landis et al.
5,604,930 A 2/1997 Petit et al.
5,970,514 A 10/1999 Wang-Lee
6,009,561 A 1/2000 Bullock et al.
6,185,739 B1 2/2001 Verkic et al.
6,253,386 B1 7/2001 Gafforio
6,298,498 B1 10/2001 Burns et al.
6,301,721 B1 10/2001 Arai
6,308,336 B1 10/2001 Stephenson et al.
6,389,606 B1 5/2002 Galet et al.
6,457,179 B1 10/2002 Prendergast
6,463,590 B1 10/2002 Dean et al.
6,472,776 B1 10/2002 Soto et al.
6,481,025 B2 11/2002 Hill
6,591,424 B1 7/2003 Wang-Lee
6,622,314 B1 9/2003 Kim et al.
6,687,909 B1 2/2004 Witkoff
6,711,751 B1 3/2004 Muskovitz
6,711,753 B2 3/2004 Arai
6,739,718 B1 5/2004 Jung
6,751,810 B1 6/2004 Prendergast
6,751,811 B1 6/2004 Hill
6,754,911 B1 6/2004 Howell
6,820,285 B2 11/2004 Bataille et al.
6,892,393 B1 5/2005 Provost et al.
D526,446 S 8/2006 Cowan et al.
7,181,777 B2 * 2/2007 Choi ..... A42B 3/222 2/424
D541,991 S 5/2007 Lawrence
7,219,370 B1 5/2007 Teetzel et al.
7,226,183 B2 6/2007 Galli et al.
7,258,436 B2 8/2007 Heil
7,376,981 B2 * 5/2008 Shida ..... A42B 3/326 2/424
7,406,721 B2 8/2008 Husbands et al.
7,517,108 B2 4/2009 Galli et al.
7,814,579 B2 10/2010 Dion
7,841,026 B2 11/2010 Makris et al.
7,849,517 B2 12/2010 Rogers et al.
7,908,667 B2 3/2011 Rogers et al.
7,908,668 B2 3/2011 Folkesson
8,011,025 B2 9/2011 Lee
8,015,626 B2 9/2011 Grassi et al.
8,028,344 B2 10/2011 Rogers et al.
8,032,946 B2 10/2011 Ishikawa
8,051,500 B2 11/2011 Lee
8,056,152 B2 11/2011 Brace
8,069,499 B2 12/2011 Isobe
8,161,577 B2 4/2012 Tews
8,245,320 B2 8/2012 Provost et al.
8,286,269 B2 10/2012 Springer et al.
8,286,270 B2 * 10/2012 Higgins ..... G02B 27/0176 2/422
8,321,962 B2 12/2012 Moyses
8,375,473 B2 2/2013 Celona et al.
8,387,162 B2 * 3/2013 Huh ..... A42B 3/14 2/8.2
8,434,167 B2 5/2013 Gleason et al.
8,555,424 B2 10/2013 Higgins
8,622,593 B2 1/2014 Cristoforo
8,635,715 B2 * 1/2014 Hunt ..... A42B 3/223 2/422
D700,401 S 2/2014 Larrivee
8,671,467 B2 3/2014 Tack et al.
8,745,763 B2 * 6/2014 Cho ..... A42B 3/223 2/15
8,806,667 B2 8/2014 Pfanner et al.
8,826,463 B2 9/2014 Teetzel et al.
8,918,912 B2 12/2014 Cho
9,072,328 B2 7/2015 Rogers et al.
9,116,355 B2 8/2015 Teetzel et al.
9,125,447 B2 * 9/2015 Lebel ..... A44B 17/0076
D750,846 S 3/2016 Noordzij et al.
D750,847 S 3/2016 Noordzij et al.
D759,900 S 6/2016 Cummings et al.
9,402,434 B2 8/2016 Isobe
D766,521 S 9/2016 Hanudel
9,433,252 B2 9/2016 Lebel et al.
9,439,470 B2 9/2016 McGinn et al.
9,516,911 B2 * 12/2016 Happel ..... A42B 3/225
D778,508 S 2/2017 Moreau et al.
9,578,916 B2 2/2017 Daniels et al.
9,625,699 B2 4/2017 Teetzel et al.
9,631,899 B2 4/2017 Lebel et al.
D788,377 S 5/2017 Hanudel
9,693,595 B2 7/2017 Lebel et al.
9,717,294 B2 8/2017 Rogers et al.
9,788,587 B2 10/2017 Auranen et al.
9,788,593 B2 * 10/2017 Lebel ..... A42B 3/326
9,829,772 B2 11/2017 Harrison et al.
9,839,252 B2 12/2017 Krick et al.
9,848,665 B2 12/2017 Gendron et al.
D806,957 S 1/2018 Noordzij et al.
9,854,866 B2 1/2018 Berthier et al.
10,022,273 B2 7/2018 Huh
10,143,259 B2 12/2018 Liao et al.
10,165,819 B2 1/2019 Klotz et al.
10,219,579 B2 3/2019 Gotti
10,448,693 B2 10/2019 Noordzij et al.
10,568,380 B2 * 2/2020 Salvetti ..... A42B 3/223
D877,887 S 3/2020 Kelly et al.
10,617,168 B2 4/2020 Winters et al.
10,786,032 B2 * 9/2020 Hunt ..... A42B 3/223
10,881,943 B2 1/2021 Isserow et al.
11,019,872 B2 6/2021 Calilung et al.
2002/0138897 A1 10/2002 Arai
2003/0088907 A1 5/2003 Gafforio et al.
2004/0181856 A1 9/2004 Oleson
2004/0199982 A1 * 10/2004 Wang-Lee ..... A42B 3/04 2/424
2006/0070160 A1 4/2006 Reitz
2007/0226865 A1 10/2007 Lindgren
2008/0066208 A1 3/2008 Tagliente
2008/0089058 A1 4/2008 Galli et al.
2008/0184465 A1 8/2008 Chang
2008/0216215 A1 9/2008 Lee
2008/0263752 A1 10/2008 Solinsky et al.
2009/0126059 A1 5/2009 Tack et al.
2009/0313745 A1 12/2009 Kang et al.
2010/0012692 A1 1/2010 Harris et al.
2010/0175172 A1 7/2010 Dempsey et al.
2011/0113535 A1 5/2011 Lebel et al.
2011/0302701 A1 12/2011 Kuo
2012/0069292 A1 3/2012 Park
2012/0204331 A1 8/2012 Lebel et al.
2012/0246807 A1 10/2012 Klotz et al.
2013/0031692 A1 2/2013 Wratten
2013/0191967 A1 8/2013 Harris
2013/0212785 A1 8/2013 Ratti et al.
2014/0000014 A1 1/2014 Redpath et al.
2014/0020153 A1 1/2014 Romanski et al.
2014/0123367 A1 5/2014 Prenatt
2014/0352020 A1 * 12/2014 Isobe ..... A42B 3/223 2/9
2015/0089726 A1 4/2015 Long
2015/0245682 A1 9/2015 McGinn et al.
2016/0000170 A1 1/2016 Simons et al.
2016/0015114 A1 1/2016 Berthier et al.
2016/0324248 A1 11/2016 Winters et al.
2017/0049176 A1 2/2017 Giroux Bernier et al.
2017/0112225 A1 4/2017 Gotti
2017/0112226 A1 4/2017 Watkins et al.
2017/0127745 A1 5/2017 Daniels et al.

(56) References Cited

U.S. PATENT DOCUMENTS

| | | | | |
|---|---|---|---|---|
| 2017/0150769 | A1 | 6/2017 | Lebel et al. | |
| 2017/0215508 | A1 | 8/2017 | Salvetti et al. | |
| 2017/0273385 | A1 | 9/2017 | Scheller | |
| 2017/0280807 | A1 | 10/2017 | Rogers et al. | |
| 2017/0318889 | A1* | 11/2017 | Nagely | A42B 3/046 |
| 2017/0325534 | A1 | 11/2017 | Noordzij et al. | |
| 2018/0070669 | A1 | 3/2018 | Krick et al. | |
| 2018/0242677 | A1* | 8/2018 | Pilenga | A61F 9/029 |
| 2018/0292178 | A1 | 10/2018 | Gehring et al. | |
| 2018/0338559 | A1 | 11/2018 | Plunkett et al. | |
| 2019/0090577 | A1* | 3/2019 | Stolker | A42B 3/185 |
| 2019/0133236 | A1* | 5/2019 | Shida | G02C 3/00 |
| 2019/0191811 | A1 | 6/2019 | Eley, Sr. | |
| 2019/0209912 | A1 | 7/2019 | Isserow et al. | |
| 2019/0380421 | A1 | 12/2019 | Noordzij et al. | |

FOREIGN PATENT DOCUMENTS

| | | | | | |
|---|---|---|---|---|---|
| DE | 602005001171 | T2 | | 1/2008 | |
| DE | 102010027015 | A1 | | 1/2012 | |
| EP | 1293139 | A1 | | 3/2003 | |
| EP | 1057419 | B1 | | 7/2003 | |
| EP | 1366682 | A2 | | 12/2003 | |
| EP | 1459637 | A1 | | 9/2004 | |
| EP | 1498041 | A1 | | 1/2005 | |
| EP | 1345505 | B1 | | 11/2005 | |
| EP | 2004000 | B1 | | 10/2006 | |
| EP | 1591030 | B1 | | 5/2007 | |
| EP | 1836912 | A2 | | 9/2007 | |
| EP | 1245165 | B1 | | 5/2008 | |
| EP | 2062489 | A2 | | 5/2009 | |
| EP | 2222377 | B1 | | 9/2010 | |
| EP | 2225959 | A2 | | 9/2010 | |
| EP | 1856999 | B1 | | 10/2010 | |
| EP | 2311337 | A1 | | 4/2011 | |
| EP | 2378908 | A1 | | 10/2011 | |
| EP | 1853129 | B1 | | 12/2011 | |
| EP | 2299857 | B1 | | 3/2012 | |
| EP | 2254431 | B1 | | 4/2012 | |
| EP | 2517586 | B1 | | 10/2012 | |
| EP | 2229829 | B1 | | 1/2013 | |
| EP | 2554068 | B1 | | 1/2014 | |
| EP | 2273898 | B1 | | 1/2015 | |
| EP | 2498637 | B1 | | 3/2015 | |
| EP | 2978330 | B1 | | 2/2016 | |
| EP | 2810577 | B1 | | 3/2016 | |
| EP | 2693903 | B1 | | 6/2016 | |
| EP | 2806759 | B1 | | 6/2016 | |
| EP | 2460425 | B1 | | 10/2016 | |
| EP | 2628402 | B1 | | 1/2017 | |
| EP | 2976957 | B1 | | 3/2017 | |
| EP | 3162232 | A1 | | 5/2017 | |
| EP | 3185709 | A1 | | 7/2017 | |
| EP | 3195745 | A1 | | 7/2017 | |
| EP | 3203869 | A1 | | 8/2017 | |
| EP | 2473075 | B1 | | 11/2017 | |
| EP | 2806760 | B1 | | 6/2018 | |
| ES | 2204095 | T3 | | 4/2004 | |
| ES | 2285598 | T3 | | 11/2007 | |
| ES | 2625394 | T3 | | 7/2017 | |
| ES | 2646419 | T3 | | 12/2017 | |
| FR | 2851127 | A1 | | 8/2004 | |
| FR | 2951055 | A1 | | 4/2011 | |
| FR | 3023681 | A1 | | 1/2016 | |
| FR | 3046911 | A1 | | 7/2017 | |
| GB | 815498 | A | | 6/1959 | |
| GB | 867932 | A | | 5/1961 | |
| GB | 2068212 | A | | 8/1981 | |
| KR | 20140045740 | A | | 4/2014 | |
| KR | 101397142 | B1 | | 5/2014 | |
| PT | 1591030 | E | | 8/2007 | |
| WO | WO-9528100 | A1 | * | 10/1995 | A42B 3/283 |
| WO | 2008060039 | A1 | | 5/2008 | |
| WO | 2015108854 | A1 | | 7/2015 | |
| WO | 2015123280 | A1 | | 8/2015 | |
| WO | 2016029327 | A1 | | 3/2016 | |
| WO | 2016057792 | A1 | | 4/2016 | |
| WO | 2016205757 | A1 | | 12/2016 | |
| WO | 2017029551 | A2 | | 2/2017 | |
| WO | 2017062368 | A1 | | 4/2017 | |
| WO | 2019139926 | A1 | | 7/2019 | |

* cited by examiner

PROTECTIVE HELMET WITH FACE PROTECTION SHIELD AND LINKAGE MECHANISM

BACKGROUND OF THE DISCLOSURE

Field of the Disclosure

The present disclosure relates generally to a protective helmet having an eye or face protection shield, and more particularly, to a protective helmet having an eye or face protection shield with a linkage mechanism for moving the protection shield between a deployed position and a stowed position.

Description of Related Art

Protective helmets are widely used in a variety of environments. A protective helmet typically includes a hard shell for protecting the head of the user. One or more accessories may be removably or non-removably attached to the hard shell of the protective helmet. In some examples, the one or more accessories may be configured to provide additional protection to the user, such as protecting the eyes and/or face of the user. Such accessories may be movable between a first or deployed position and a second or stowed position. For example, in the first position, a protection shield may extend in front of the user's face to prevent debris or other materials from hitting the user's eyes and/or face. In the second position, the eye or face protection shield can be moved away from the user's face when the circumstances do not require the additional protection or when the user desires to remove the protective helmet.

On some helmets, the eye or face protection shield is connected to the helmet so as to be located on the exterior of the helmet shell when it is in the raised position. A linkage mechanism connects the eye or face protection shield to the helmet and allows for movement of the protection shield between the deployed position and the stowed position. Conventional linkage mechanisms do not allow for assisted movement of the face protection shield between the deployed position and the stowed position, or vice versa.

Accordingly, there is a need in the art for an improved protective helmet having a face protection shield that addresses certain drawbacks and deficiencies associated with existing protective helmets. For example, there is a need for an improved protective helmet that can be easily and effectively worn by the user in a variety of environments while allowing for easy movement of an eye or face protection shield between the deployed position and the stowed position.

SUMMARY OF THE DISCLOSURE

In accordance with some non-limiting examples or aspects of the present disclosure, provided is an improved protective helmet that can be easily and effectively worn by the user in a variety of environments while allowing for easy movement of a protection shield between a deployed position and a stowed position. A protective helmet may have an outer shell configured for surrounding a head of a user, and a protection shield movable relative to the outer shell between a deployed position, where the protection shield extends forward of a front portion of the outer shell, and a stowed position, where the protection shield extends over an upper portion of the outer shell. The protective helmet further may have a linkage mechanism for connecting the protection shield to the outer shell and permitting movement of the protection shield between the deployed position and the stowed position. The linkage mechanism may have a first link having a first end connected to the outer shell and a second end connected to the protection shield, a second link having a first end connected to the outer shell and a second end connected to the protection shield, and a biasing member having a first end connected to the first link and a second end connected to the second link. The second end of the biasing member may move between the first end of the second link and the second end of the second link during movement of the protection shield between the deployed position and the stowed position.

In accordance with some non-limiting embodiments or aspects of the present disclosure, the second link may have a slot extending between the first end and the second end with a bar extending between a first slot end and a second slot end. The second end of the biasing member may be connected to the bar such that the biasing member moves along the bar between the first slot end and the second slot end during movement of the protection shield between the deployed position and the stowed position. The slot may be angled at an acute angle or parallel relative to a major longitudinal axis extending between the first end of the second link and the second end of the second link.

In accordance with some non-limiting embodiments or aspects of the present disclosure, the first end of the biasing element may be a loop that is connected to a hook-shaped retaining element on the first link. The first end of the biasing element may pivot about the retaining element during movement of the protection shield between the deployed position and the stowed position. The biasing element may be movable between a first or unstretched configuration to a second or stretched configuration upon application of a biasing force to at least one of the first end of the biasing member and the second end of the biasing member due to movement of the protection shield to an intermediate position between the deployed position and the stowed position. In the second or stretched configuration, the biasing element may provide assistance during movement of the protection shield from the intermediate position toward the deployed position or the stowed position. The biasing element may be a tension spring.

In accordance with some non-limiting embodiments or aspects of the present disclosure, the first end of the first link may be pivotally movable relative to the outer shell about a first pivot axis and the second end of the first link may be pivotally movable relative to the protection shield about a second pivot axis substantially parallel to the first pivot axis and offset from the first pivot axis. The first end of the second link may be pivotally movable relative to the outer shell about a third pivot axis and the second end of the second link may be pivotally movable relative to the protection shield about a fourth pivot axis substantially parallel to the third pivot axis and offset from the third pivot axis.

In accordance with some non-limiting embodiments or aspects of the present disclosure, the first end of the first link and the first end of the second link are connected to the outer shell by a locking tab. The locking tab may have a rail that is shaped to be slidably received within a groove of an accessory attachment rail on a lateral portion of the outer shell. The locking tab may have a release button for releasing the locking tab from the accessory attachment rail.

In accordance with some non-limiting embodiments or aspects of the present disclosure, a linkage mechanism for connecting a protection shield to an outer shell of a protective helmet may have a first link having a first end configured for connecting to the outer shell and a second end configured for connecting to the protection shield, a second link having a first end configured for connecting to the outer shell and a second end configured for connecting to the protection shield, and a biasing member having a first end connected to the first link and a second end connected to the second link. The second end of the biasing member may be configured to move between the first end of the second link and the second end of the second link during movement of the protection shield between a deployed position and a stowed position.

In accordance with some non-limiting embodiments or aspects of the present disclosure, the second link may have a slot extending between the first end and the second end with a bar extending between a first slot end and a second slot end. The second end of the biasing member may be connected to the bar such that the biasing member is configured to move along the bar between the first slot end and the second slot end during movement of the protection shield between the deployed position and the stowed position. The first end of the biasing element may be a loop that is connected to a hook-shaped retaining element on the first link. The biasing element may be movable between a first or unstretched configuration to a second or stretched configuration upon application of a biasing force to at least one of the first end of the biasing member and the second end of the biasing member due to movement of the protection shield to an intermediate position between the deployed position and the stowed position.

Further non-limiting embodiments or aspects will now be set forth in the following numbered clauses.

Clause 1. A protective helmet comprising: an outer shell configured for surrounding a head of a user; a protection shield movable relative to the outer shell between a deployed position, where the protection shield extends forward of a front portion of the outer shell, and a stowed position, where the protection shield extends over an upper portion of the outer shell; and a linkage mechanism for connecting the protection shield to the outer shell and permitting movement of the protection shield between the deployed position and the stowed position, the linkage mechanism comprising: a first link having a first end connected to the outer shell and a second end connected to the protection shield; a second link having a first end connected to the outer shell and a second end connected to the protection shield; and a biasing member having a first end connected to the first link and a second end connected to the second link, wherein the second end of the biasing member moves between the first end of the second link and the second end of the second link during movement of the protection shield between the deployed position and the stowed position.

Clause 2. The protective helmet according to clause 1, wherein the second link has a slot extending between the first end and the second end with a bar extending between a first slot end and a second slot end.

Clause 3. The protective helmet according to clause 1 or 2, wherein the second end of the biasing member is connected to the bar such that the biasing member moves along the bar between the first slot end and the second slot end during movement of the protection shield between the deployed position and the stowed position.

Clause 4. The protective helmet according to any of clauses 1-3, wherein the slot is angled at an acute angle relative to a major longitudinal axis extending between the first end of the second link and the second end of the second link.

Clause 5. The protective helmet according to any of clauses 1-4, wherein the slot is parallel with a major longitudinal axis extending between the first end of the second link and the second end of the second link.

Clause 6. The protective helmet according to any of clauses 1-5, wherein the first end of the biasing element is a loop that is connected to a hook-shaped retaining element on the first link.

Clause 7. The protective helmet according to any of clauses 1-6, wherein the first end of the biasing element pivots about the retaining element during movement of the protection shield between the deployed position and the stowed position.

Clause 8. The protective helmet according to any of clauses 1-7, wherein the biasing element is movable between a first or unstretched configuration to a second or stretched configuration upon application of a biasing force to at least one of the first end of the biasing member and the second end of the biasing member due to movement of the protection shield to an intermediate position between the deployed position and the stowed position.

Clause 9. The protective helmet according to any of clauses 1-8, wherein, in the second or stretched configuration, the biasing element provides assistance during movement of the protection shield from the intermediate position toward the deployed position or the stowed position.

Clause 10. The protective helmet according to any of clauses 1-9, wherein the biasing element is a tension spring.

Clause 11. The protective helmet according to any of clauses 1-10, wherein the first end of the first link is pivotally movable relative to the outer shell about a first pivot axis and wherein the second end of the first link is pivotally movable relative to the protection shield about a second pivot axis substantially parallel to the first pivot axis and offset from the first pivot axis.

Clause 12. The protective helmet according to any of clauses 1-11, wherein the first end of the second link is pivotally movable relative to the outer shell about a third pivot axis and wherein the second end of the second link is pivotally movable relative to the protection shield about a fourth pivot axis substantially parallel to the third pivot axis and offset from the third pivot axis.

Clause 13. The protective helmet according to any of clauses 1-12, wherein the first end of the first link and the first end of the second link are connected to the outer shell by a locking tab.

Clause 14. The protective helmet according to any of clauses 1-13, wherein the locking tab has a rail that is shaped to be slidably received within a groove of an accessory attachment rail on a lateral portion of the outer shell.

Clause 15. The protective helmet according to any of clauses 1-14, wherein the locking tab has a release button for releasing the locking tab from the accessory attachment rail.

Clause 16. A linkage mechanism for connecting a protection shield to an outer shell of a protective helmet, the linkage mechanism comprising: a first link having a first end configured for connecting to the outer shell and a second end configured for connecting to the protection shield; a second link having a first end configured for connecting to the outer shell and a second end configured for connecting to the protection shield; and a biasing member having a first end connected to the first link and a second end connected to the second link, wherein the second end of the biasing member is configured to move between the first end of the second link and the second end of the second link during movement of the protection shield between a deployed position and a stowed position.

Clause 17. The linkage mechanism according to clause 16, wherein the second link has a slot extending between the first end and the second end with a bar extending between a first slot end and a second slot end.

Clause 18. The linkage mechanism according to clause 16 or 17, wherein the second end of the biasing member is connected to the bar such that the biasing member is configured to move along the bar between the first slot end and the second slot end during movement of the protection shield between the deployed position and the stowed position.

Clause 19. The linkage mechanism according to any of clauses 16-18, wherein the first end of the biasing element is a loop that is connected to a hook-shaped retaining element on the first link.

Clause 20. The linkage mechanism according to any of clauses 16-19, wherein the biasing element is movable between a first or unstretched configuration to a second or stretched configuration upon application of a biasing force to at least one of the first end of the biasing member and the second end of the biasing member due to movement of the protection shield to an intermediate position between the deployed position and the stowed position.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

BRIEF DESCRIPTION OF THE DRAWINGS

In FIGS. 1-5C, like characters refer to the same components and elements, as the case may be, unless otherwise stated.

DETAILED DESCRIPTION OF THE DISCLOSURE

Figure 1A:
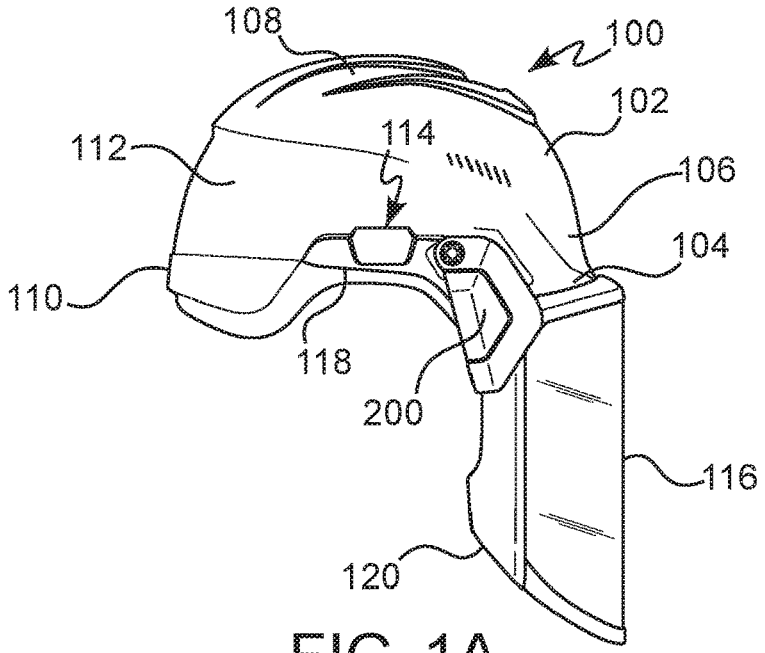
FIG. 1A is a side perspective view of a protective helmet and a protection shield in accordance with some non-limiting examples or aspects of the present disclosure, with the protection shield shown in a deployed position.

As used herein, the singular form of "a", "an", and "the" include plural referents unless the context clearly dictates otherwise.

Spatial or directional terms, such as "left", "right", "inner", "outer", "above", "below", and the like, relate to the invention as shown in the drawing figures and are not to be considered as limiting as the invention can assume various alternative orientations.

All numbers used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

All documents referred to herein are "incorporated by reference" in their entirety.

The term "at least" is synonymous with "greater than or equal to".

As used herein, "at least one of" is synonymous with "one or more of". For example, the phrase "at least one of A, B, or C" means any one of A, B, or C, or any combination of any two or more of A, B, or C. For example, "at least one of A, B, and C" includes A alone; or B alone; or C alone; or A and B; or A and C; or B and C; or all of A, B, and C.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

The discussion of various non-limiting examples or aspects may describe certain features as being "particularly" or "preferably" within certain limitations (e.g., "preferably", "more preferably", or "even more preferably", within certain limitations). It is to be understood that the disclosure is not limited to these particular or preferred limitations but encompasses the entire scope of the various examples and aspects described herein.

Figure 1B:
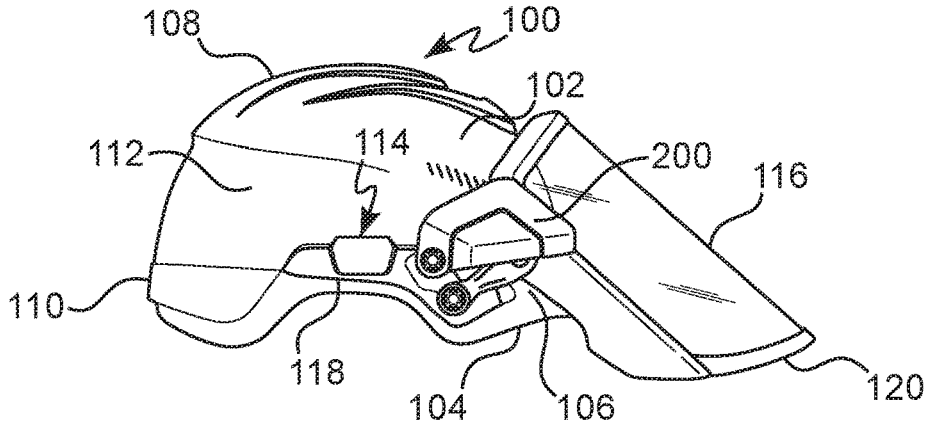
FIG. 1B is a side perspective view of the protective helmet and the protection shield of FIG. 1A with the protection shield shown in an intermediate position.
Figure 1C:
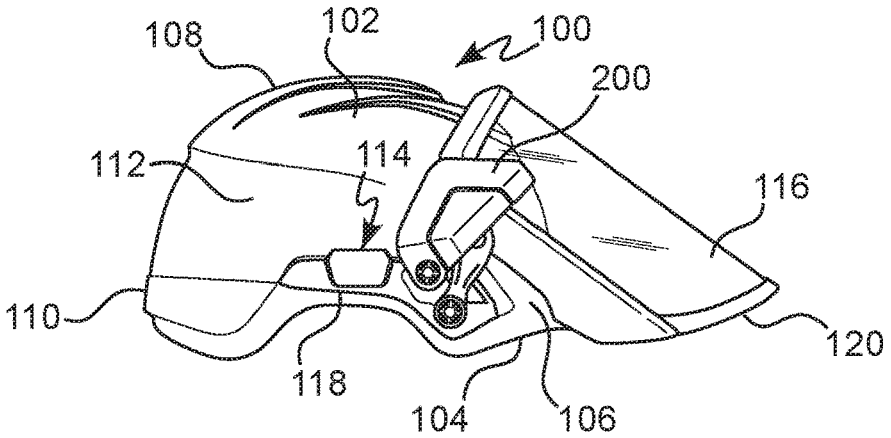
FIG. 1C is a side perspective view of the protective helmet and the protection shield of FIG. 1A with the protection shield shown in a stowed position.

With reference to FIGS. 1A-1C, provided is a protective helmet 100 (hereinafter referred to as "helmet 100") having a rigid outer shell 102 configured to surround the head of a user. In some non-limiting embodiments or aspects, the rigid outer shell 102 may be constructed from a composite material. The shell 102 has a generally hemi-spherical form and has a facial opening 104 at a front end for accommodating the user's face. The shell 102 includes a front portion 106 situated above the facial opening 104, an upper portion 108, and a rear portion 110 extending from the upper portion 108 to the nape of the user's neck. A pair of lateral portions 112 extend from the upper portion 108 on each side of the facial opening 104.

With continued reference to FIGS. 1A-1C, the helmet 100 has an accessory attachment rail 118 attached to each lateral portion 112, such as at a connection area 114 of each lateral portion 112. The accessory attachment rail 118 is configured for removably receiving at least one helmet accessory, such as a protection shield 116 protection shield or any other accessory. In some non-limiting embodiments or aspects, the protection shield 116 is configured for protecting the eyes and/or the face of the user. The at least one helmet accessory is configured to increase the functionality of the helmet 100, such as by providing additional protection to the user or providing additional capability to the helmet 100. For example, the protection shield 116 is configured to protect the user's face from environmental hazards, such as debris or heat.

In some non-limiting embodiments or aspects, the protection shield 116 is removably connectable to the helmet 100 by way of a linkage mechanism 200. A first portion of the linkage mechanism 200 may be connected to the protection shield 116, such as a frame 120 of the protection shield 116, while a second portion of the linkage mechanism 200 may be connected to the rigid outer shell 102 of the helmet 100 (such as at the connection area 114) or the accessory attachment rail 118. In some non-limiting embodiments or aspects, the linkage mechanism 200 is configured for permitting movement of the protection shield 116 between a deployed position (FIG. 1A), where the protection shield 116 is positioned directly in front of the user's face, and a stowed position (FIG. 1C), where the protection shield 116 is positioned above the user's face. For example, the protection shield 116 may be movable from the deployed position to the stowed position (and vice versa) by grasping at least a portion of the protection shield 116, such as the frame 120, and raising (or lowering) the protection shield 116 away (or toward) the user's face.

Figure 2:
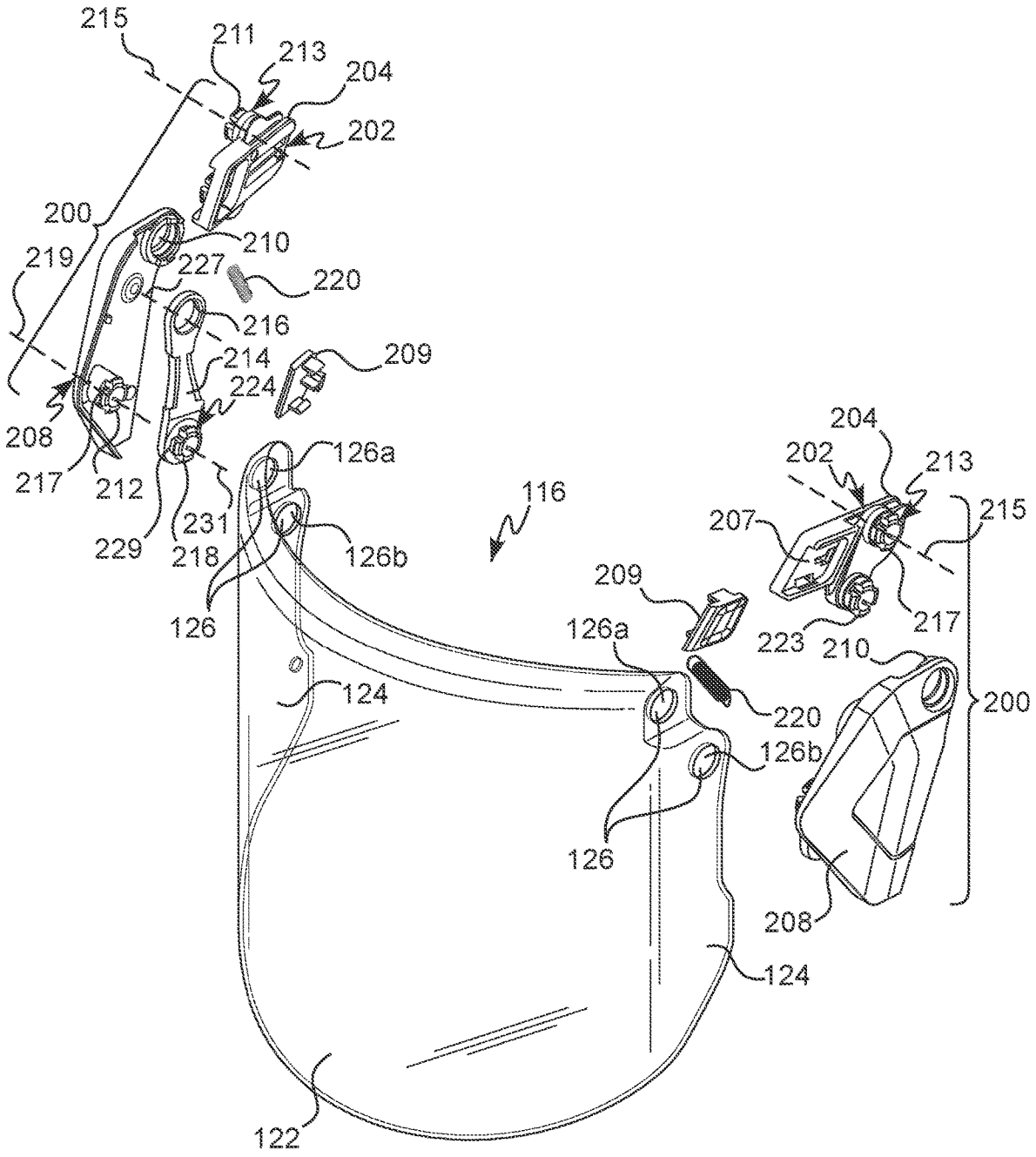
FIG. 2 is an exploded perspective view of the protection shield of FIG. 1A shown without the protective helmet.

With reference to FIG. 2, the protection shield 116 and linkage mechanism 200 are shown as an exploded assembly of parts. The protection shield 116 has a shielding portion 122 configured for being positioned in front of the user's face when the protection shield 116 is in the deployed position. In some non-limiting embodiments or aspects, the shielding portion 122 is made from a transparent plastic material to allow the user to see through the shielding portion 122 when the protection shield 116 is in the deployed position. In other non-limiting embodiments or aspects, the shielding portion 122 is made from a mesh material, such as from a metal, plastic, or fabric net. The shielding portion 122 may be curved to contour to the user's face. The curved shape of the shielding portion 122 allows the protection shield 116 to be positioned close to the user's eyes or face when the protection shield 116 is in the deployed position and close to the helmet 100 when the protection shield 116 is in the stowed position. The protection shield 116 further has a pair of wings 124 on lateral sides of the shielding portion 122. Each wing 124 has a pair of orifices 126 at its upper end for connecting the protection shield 116 to the linkage mechanism 200, as described herein.

With continued reference to FIG. 2, the linkage mechanism 200 has a locking tab 202 configured for connecting the linkage mechanism 200 to the accessory attachment rail 118. In some non-limiting embodiments or aspects, the locking tab 202 may have a rail 204 that is configured to be slidably received within a groove on the accessory attachment rail 118. In other non-limiting embodiments or aspects, the locking tab 202 may be connected directly to the helmet 100, such as using fasteners or the like. For example, the locking tab 202 may be connected directly to the connection area 114 at the lateral side 112 of the helmet 100.

With continued reference to FIG. 2, the locking tab 202 may be configured for removably connecting the linkage mechanism 200 to the accessory attachment rail 118 or the helmet 100. The locking tab 202 can be connected to the accessory attachment rail 118 by aligning the rail 204 of the locking tab 202 with the groove on the accessory attachment rail 118 and moving the locking tab 202 within the groove of the accessory attachment rail 118 until the locking tab 202 is automatically retained within a receiving cavity on the accessory attachment rail. To remove the locking tab 202 from the accessory attachment rail 118, the locking tab 202 may have a release button 209. In some non-limiting embodiments or aspects, the release button 209 is received within a slot 207 on the locking tab 202. The release button 209 is configured for contacting a locking lever on the locking tab 202 and deflecting the locking lever with the pressing of the release button 209 in a direction toward the helmet 100. Such movement of the release button 209 deflects the locking lever to disengage the locking tab 202 from the accessory attachment rail 118 to allow the locking tab 202 to be removed from the groove on the accessory attachment rail 118. In some non-limiting embodiments or aspects, the locking tab 202 may correspond to the locking mechanism disclosed in U.S. patent application Ser. No. 16/207,842, the disclosure of which is hereby incorporated by reference in its entirety.

With continued reference to FIG. 2, the linkage mechanism 200 further has a first link 208 having a first end configured for connecting to the locking tab 202 and a second end configured for connecting to the protection shield 116. In some non-limiting embodiments or aspects, the first end of the first link 208 is connected to the locking tab 202 by a first connection arrangement. In some non-limiting embodiments or aspects, the first connection arrangement may be a cantilevered beam arrangement. For example, one of the locking tab 202 and the first link 208 may have a first connector 213 having one or more first cantilevered beams 211 while the other of the locking tab 202 and the first link 208 has an opening 210 sized to receive the first connector 213. The one or more first cantilevered beams 211 of the first connector 213 are configured to deflect from a first, undeflected position to a second, deflected position upon contact of the first connector 213 with an inner surface of the opening 210. With the one or more first cantilevered beams 211 in their deflected position, the locking tab 202 or the first link 208 may be pushed to allow the one or more first cantilevered beams 211 of the first connector 213 to enter the opening 210 and spring back to the first, undeflected position to secure the locking tab 202 to the first link 208. Once the first connector 213 is connected to the opening 210, the first link 208 may pivot about a first pivot axis 215 relative to the locking tab 202. In some non-limiting embodiments or aspects, the first pivot axis 215 extends through the first connector 213 and the opening 210.

With continued reference to FIG. 2, the second end of the first link 208 has a second connection arrangement for connecting the first link 208 to the protection shield 116. In some non-limiting embodiments or aspects, the second connection arrangement may be a cantilevered beam arrangement similar to the first connection arrangement. For example, the second end of the first link 208 may have a second connector 217 with one or more second cantilevered beams 212. A first orifice 126*a* on the protection shield 116 is sized to receive the one or more second cantilevered beams 212 of the second connector 217. The one or more second cantilevered beams 212 are configured to deflect from a first, undeflected position to a second, deflected position upon contact with an inner surface of the first orifice 126*a*. With the one or more second cantilevered beams 212 of the second connector 217 in their deflected position, the first link 208 may be pushed toward the protection shield 116 to allow the one or more second cantilevered beams 212 to enter the opening of the first orifice 126*a* and spring back to the first, undeflected position to secure the first link 208 to the protection shield 116. Once the second connector 217 is connected to the first orifice 126*a*, the first link 208 may pivot about a second pivot axis 219 relative to the protection shield 116. In some non-limiting embodiments or aspects, the second pivot axis 219 extends through the second connector 217 and the first orifice 126*a*. The second pivot axis 219 may be substantially parallel and offset from the first pivot axis 215.

Figure 3:
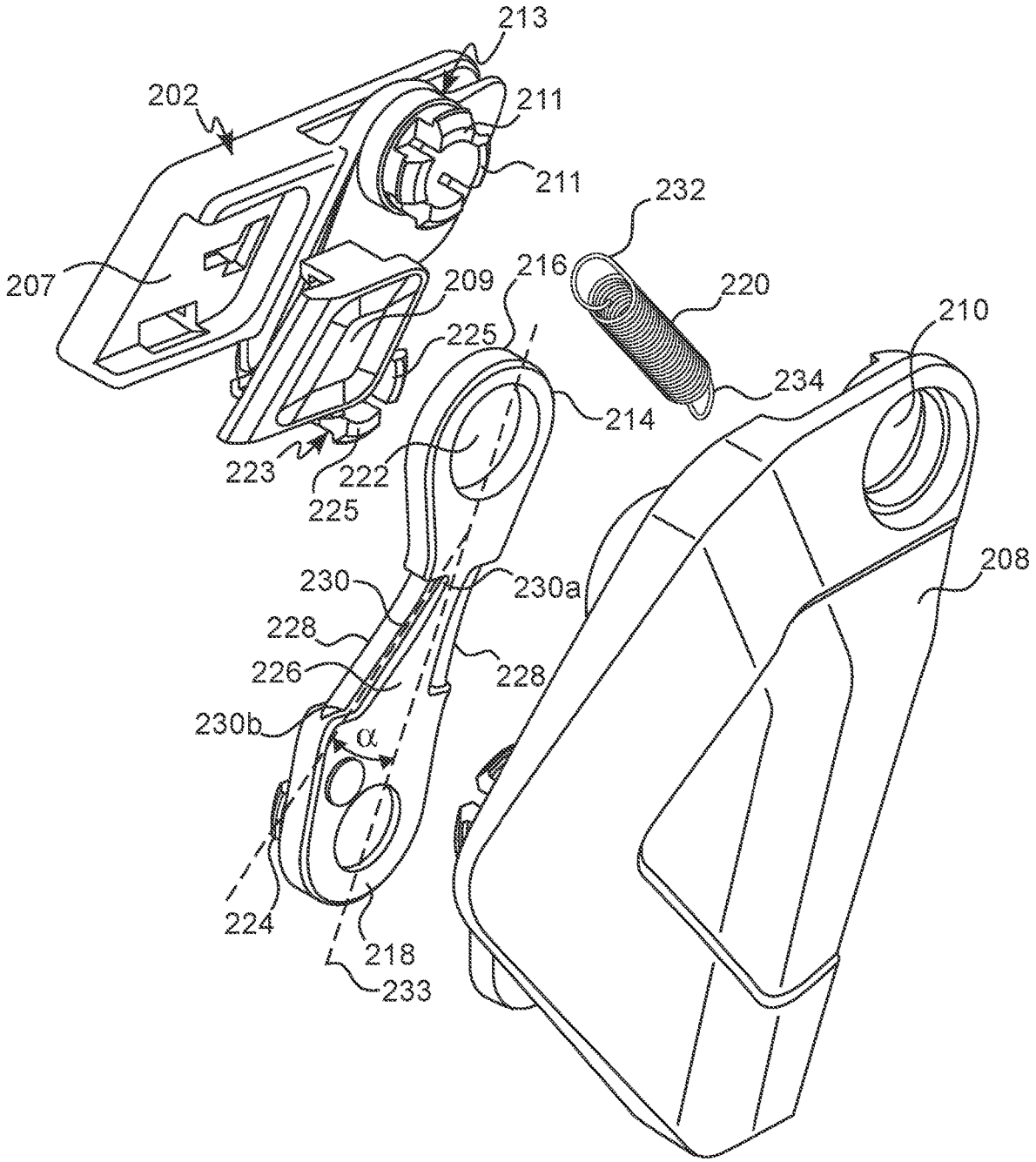
FIG. 3 is an exploded perspective view of a linkage mechanism for connecting a protection shield to a protective helmet.

With reference to FIG. 3 and with continued reference to FIG. 2, the linkage mechanism 200 has a second link 214 having a first end 216 configured for connecting to the locking tab 202 and a second end 218 configured for connecting to the protection shield 116. In some non-limiting embodiments or aspects, the first end 216 of the second link 214 and the locking tab 202 may be connected by way of a third connection arrangement. In some non-limiting embodiments or aspects, the third connection arrangement may be a cantilevered beam arrangement similar to the first connection arrangement. For example, the locking tab 202 may have a third connector 223 with one or more third cantilevered beams 225. An opening 222 on the first end 216 of the second link 214 is sized to receive the one or more third cantilevered beams 225 of the third connector 223. The one or more third cantilevered beams 225 are configured to deflect from a first, undeflected position to a second, deflected position upon contact with an inner surface of the opening 222. With the one or more third cantilevered beams 225 of the third connector 223 in their deflected position, the second link 214 may be pushed toward the locking tab 202 to allow the one or more third cantilevered beams 225 to enter the opening 222 and spring back to the first, undeflected position to secure the first end 216 of the second link 214 to the locking tab 202. Once the third connector 223 is connected to the opening 222, the first end 216 of the second link 214 may pivot about a third pivot axis 227 (shown in FIG. 4) relative to the locking tab 202. In some non-limiting embodiments or aspects, the third pivot axis 227 extends through the third connector 223 and the opening 222. The third pivot axis 227 may be substantially parallel and offset from the first pivot axis 215 and the second pivot axis 219.

With continued reference to FIGS. 2-3, the second end 218 of the second link 214 has a fourth connection arrangement for connecting the second link 214 to the protection shield 116. In some non-limiting embodiments or aspects, the fourth connection arrangement may be a cantilevered beam arrangement similar to the first connection arrangement. For example, the second end 218 of the second link 214 may have a fourth connector 224 with one or more fourth cantilevered beams 229. A second orifice 126*b* on the protection shield 116 (shown in FIG. 2) is sized to receive the one or more fourth cantilevered beams 229 of the fourth connector 224. The one or more fourth cantilevered beams 229 are configured to deflect from a first, undeflected position to a second, deflected position upon contact with an inner surface of the second orifice 126*b*. With the one or more fourth cantilevered beams 229 of the fourth connector 224 in their deflected position, the second link 214 may be pushed toward the protection shield 116 to allow the one or more fourth cantilevered beams 229 to enter the opening of the second orifice 126*b* and spring back to the first, undeflected position to secure the second end 218 of the second link 214 to the protection shield 116. Once the fourth connector 224 is connected to the second orifice 126*b*, the second end 218 of the second link 214 may pivot about a fourth pivot axis 231 relative to the protection shield 116. In some non-limiting embodiments or aspects, the fourth pivot axis 231 extends through the fourth connector 224 and the second orifice 126*b*. The fourth pivot axis 231 may be substantially parallel and offset from the first pivot axis 215, the second pivot axis 219, and the third pivot axis 227.

With reference to FIG. 3, the second link 214 has an intermediate portion 226 between first end 216 and the second end 218 in a direction along a major longitudinal axis 233 of the second link 214. The intermediate portion 226 has at least one slot 230 extending through the material of the second link 214 between a first slot end 230*a* and a second slot end 230*b*. In some non-limiting embodiments to aspects, the at least one slot 230 may be angled at an acute angle $\alpha$ relative to the major longitudinal axis 233. In other non-limiting embodiments or aspects, the at least one slot 230 is parallel with the major longitudinal axis 233. The slot 230 may be closed by a bar 228 extending between the first slot end 230*a* and the second slot end 230*b*.

Figure 4:
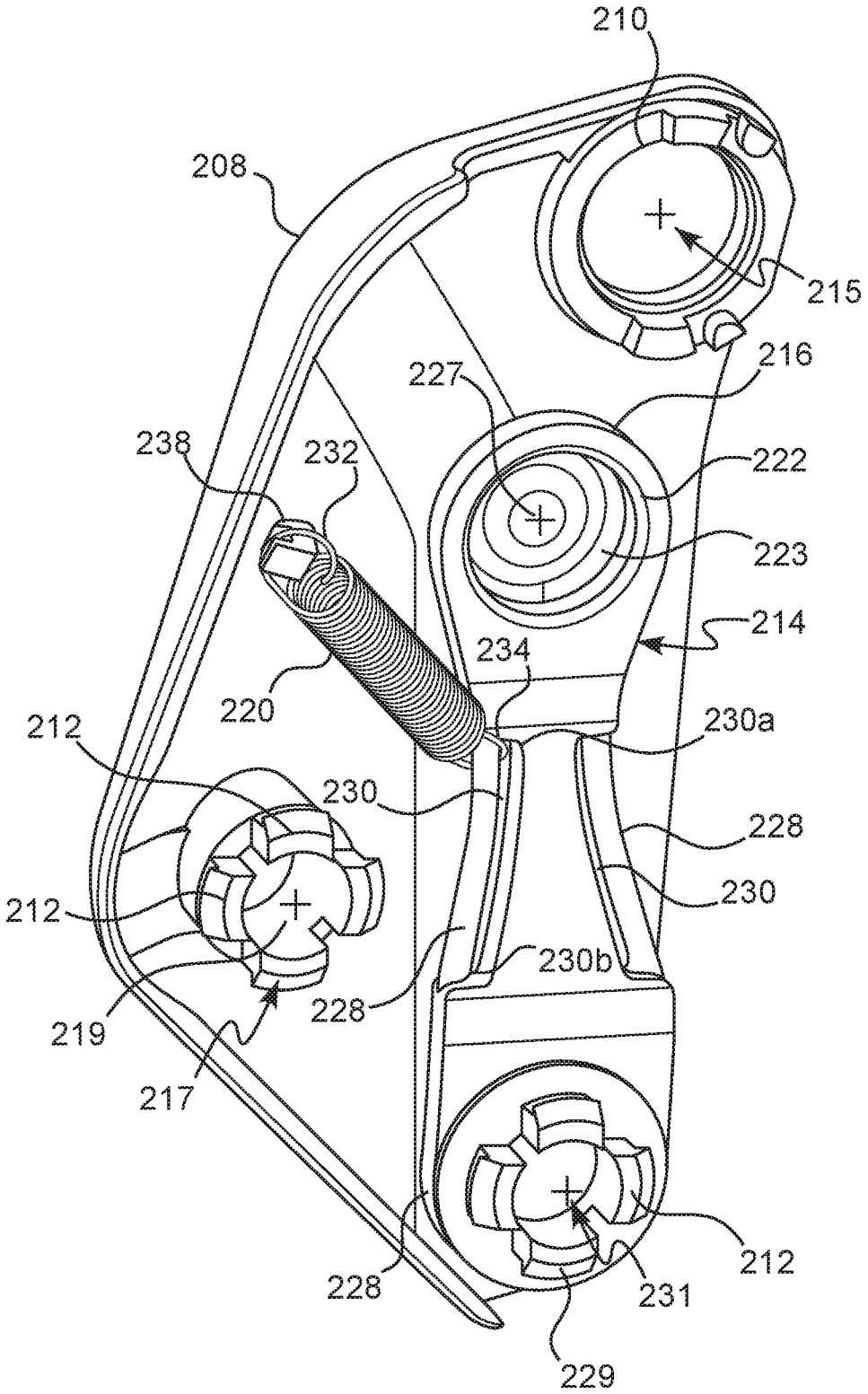
FIG. 4 is a side perspective view of the linkage mechanism shown in FIG. 3.

With reference to FIG. 4, and with continued reference to FIG. 3, the linkage mechanism 200 has a biasing element 220 having a first end 232 configured for connecting to the first link 208 and a second end 234 configured for connecting to the bar 228 of the slot 230. In some non-limiting embodiments or aspects, the biasing element 220 may be an elastically-resilient member, such as a tension spring. The biasing element 220 may be movable between a first, or unstretched configuration to a second, or stretched configuration due to application of a biasing force to at least one of the first end 232 and the second end 234. The biasing element 220 is configured to provide a restoring force when the biasing element 220 is stretched in a direction along its major longitudinal axis, such as when the first end 232 and the second end 234 are pulled away from each other due to the biasing force. The restoring force is directed in a direction opposite to the biasing force to bring the biasing element 220 from the second or stretched configuration to the first or unstretched configuration. In some non-limiting embodiments or aspects, the biasing element 220 may be in a first biased position and may stretched to a second biased position during movement of the protection shield 216 (shown in FIG. 2) between the deployed position and the stowed position, or vice versa.

With continued reference to FIG. 4, the first end 232 of the biasing element 220 is connected to a retaining element 238 on the first link 208. In some non-limiting embodiments or aspects, the first end 232 of the biasing element 220 may have a loop shape that is configured for connecting to a hook-shaped retaining element 238. The second end 234 of the biasing element 220 may be slidably connected to the bar 228 such that the second end 234 of the biasing element 220 can slide along the bar 228 between the first slot end 230*a* and the second slot end 230*b* during movement of the protection shield 116 from the deployed position and the stowed position, as described herein. The first end 232 of the biasing element 220 may pivot about the retaining element 238 during the sliding movement of the second end 234 along the bar 228.

Figure 5A:
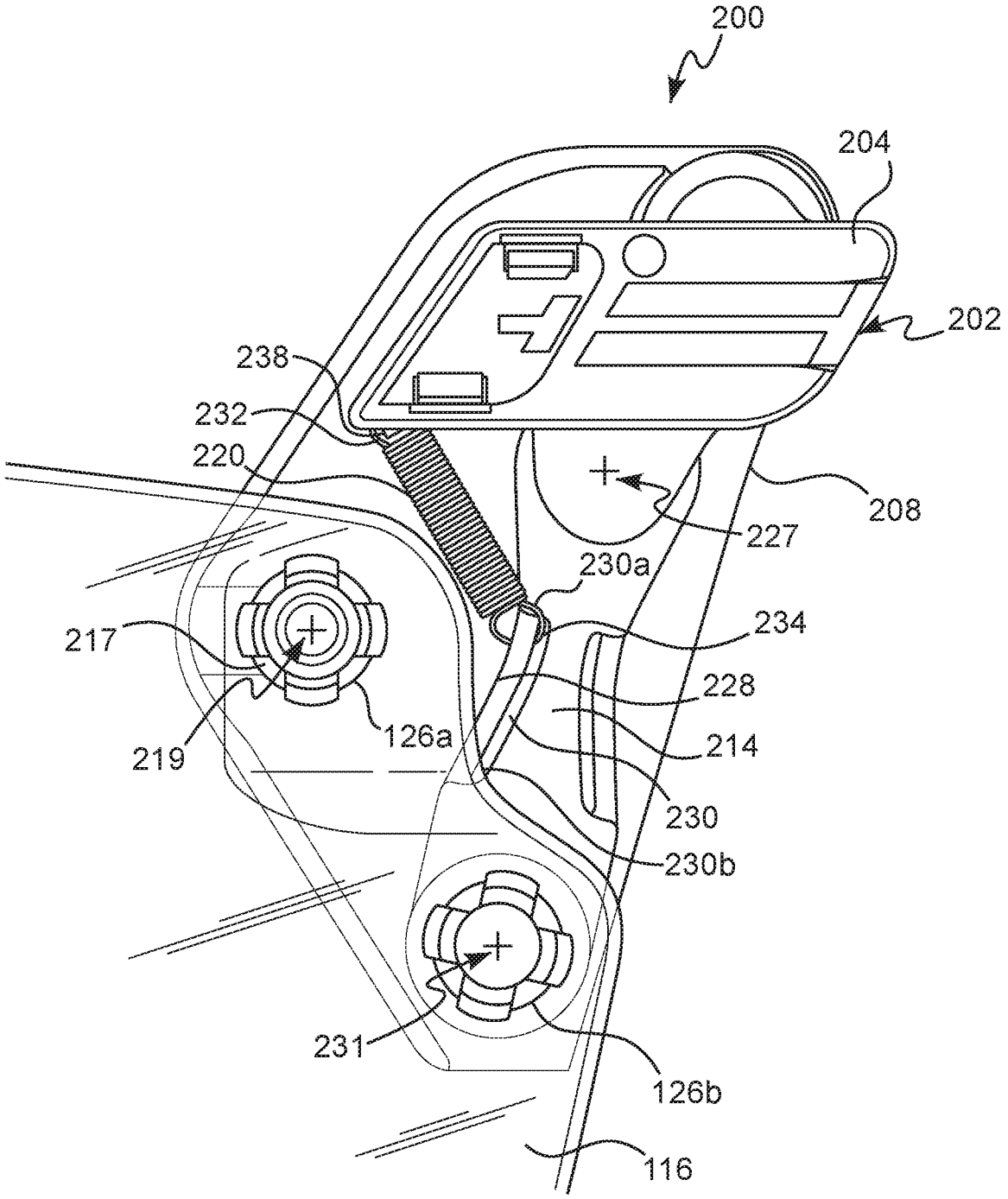
FIG. 5A is a side view of the linkage mechanism of FIG. 3 in a deployed position.
Figure 5B:
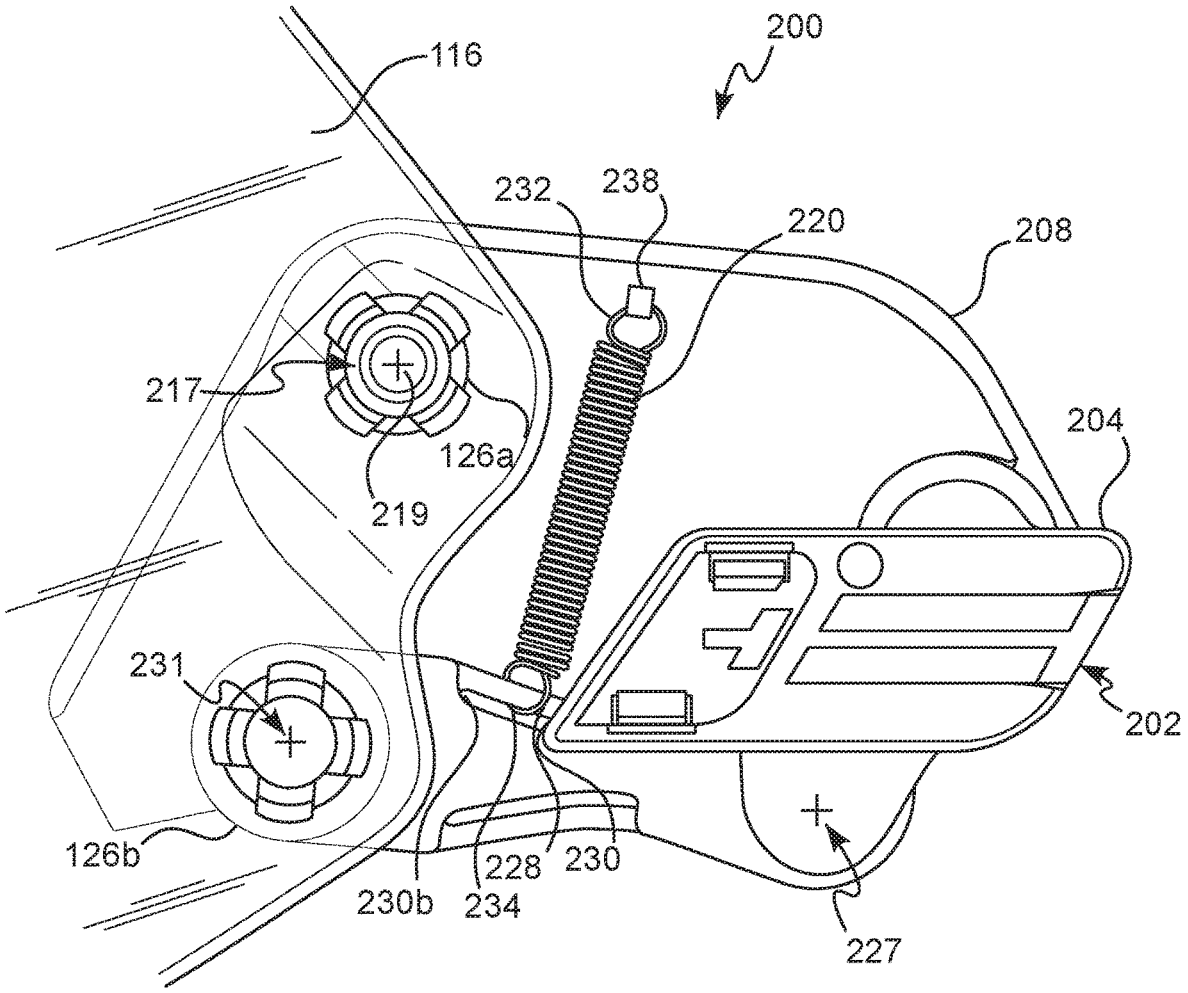
FIG. 5B is a side view of the linkage mechanism of FIG. 3 in an intermediate position.
Figure 5C:
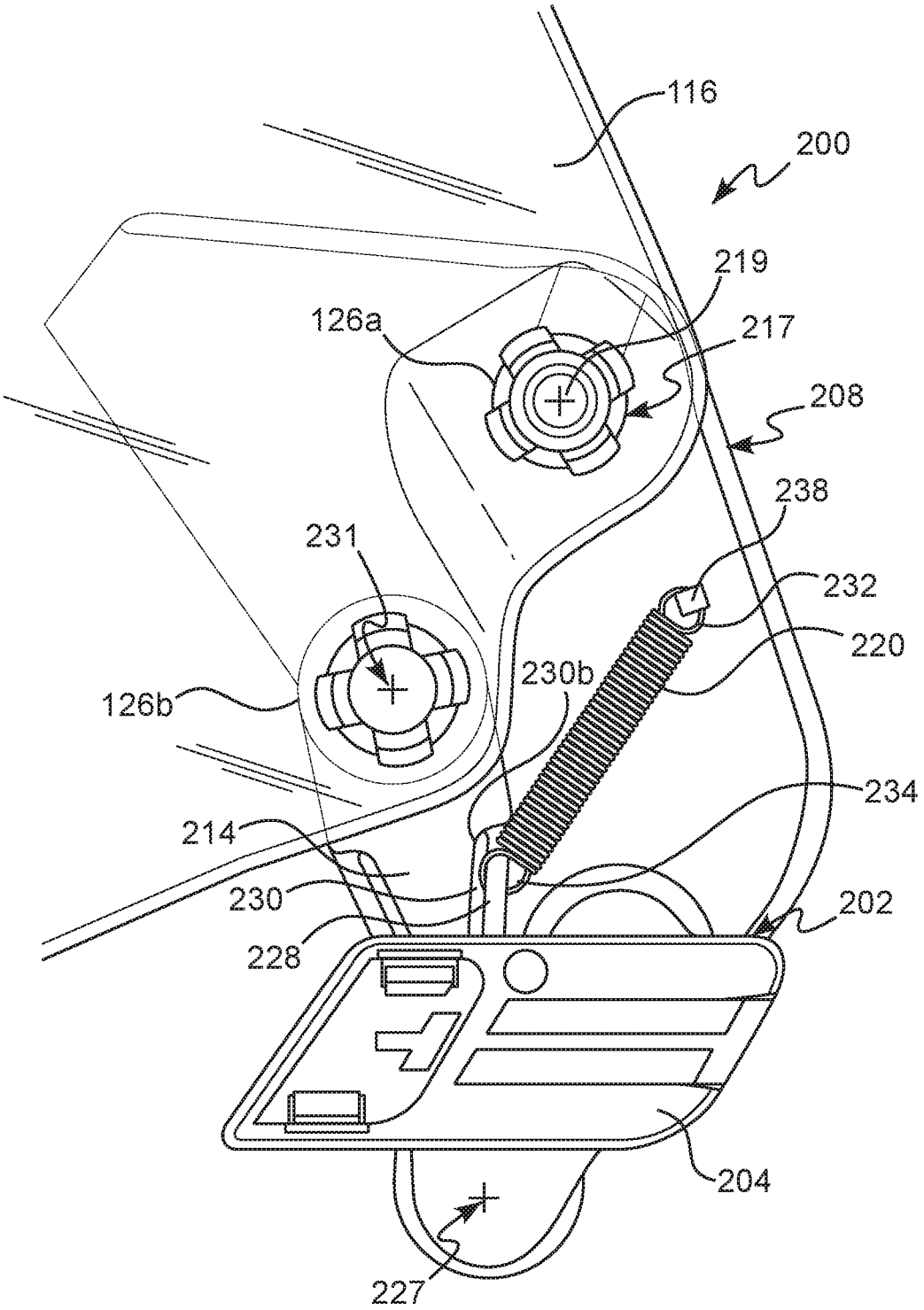
FIG. 5C is a side view of the linkage mechanism of FIG. 3 in stowed position.

Having described the structure the linkage mechanism 200 with reference to FIGS. 1-4, movement of various components of the linkage mechanism 200 during movement of the protection shield 116 between the deployed position and the stowed position will now be described with reference to FIGS. 5A-5C. In FIGS. 5A-5C, the locking tab 202 is shown in a fixed orientation while the components of the linkage mechanism 200 and the protection shield 116 move relative to the locking tab 202. Because the locking tab 202 in a fixed orientation relative to the helmet 100 (shown in FIGS. 1A-1C), such as via the rail 204 engaging a corresponding slot on the helmet 100, FIGS. 5A-5C are shown from a frame of reference of a helmet 100 with the protection shield 116 and the linkage mechanism 200 moving relative to the helmet 100.

With initial reference to FIG. 5A, the protection shield 116 is shown in a deployed position wherein the protection shield 116 is configured to be positioned in front of the user's face. In this position, the second link 214 is arranged in a first position, where the second end 234 of the biasing element 220 is positioned on the bar 228 at the first slot end 230*a*. The biasing element 220 may be in a first, or unstretched position when the protection shield 116 is in the deployed position. The first link 208 is arranged such that the opening 210 is arranged above the second connector 217 that connects the first link 208 to the first orifice 126*a* on the protection shield 116. In the deployed position, the second link 216 is arranged such that the first end 216 is positioned above the second end 218.

FIG. 5B shows the protection shield 116 in an intermediate position between the deployed position and the stowed position, while FIG. 5C shows the protection shield 116 in the stowed position. To move the protection shield 116 from the deployed position toward the stowed position, the user may grab a portion of the protection shield 116, such as a lower end of the frame 120 (shown in FIGS. 1A-1C) and rotate the protection shield 116 in an upward direction away from the user's face. Such rotation of the protection shield 116 causes the components of the linkage mechanism 200 to move in order to assist the movement of the protection shield 116 from the deployed position toward the stowed position. In particular, rotation of the protection shield 116 causes the second end 218 of the second link 214 is pivoted about the fourth pivot axis 231, thereby rotating the second link 214 such that the first end 216 and the second end 218 are next to each other in the intermediate position of the protection shield 116. Rotation of the second end 218 of the second link 214 also causes the first end 216 of the second link 214 to pivot about the third pivot axis 227 and the first link 208 to pivot about the second pivot axis 219 to account for the movement of the protection shield 116. As the second link 214 is moved, the biasing element 220 is extended from the first, unstretched position (FIG. 5A) to a second, stretched position (FIG. 5B). As the biasing element 220 is stretched, the second end 234 of the biasing element 220 slides along the bar 228 from the first slot end 230*a* toward the second slot end 230*b*, while the first end 232 of the biasing element 220 pivots about the retaining element 238 on the first link 208.

The biasing element 220 moves from the first slot end 230*a* toward the second slot end 230*b* during movement of the protection shield 116 from the deployed position toward the stowed position, and from the second slot end 230*b* toward the first slot end 230*a* during movement of the protection shield 116 from the stowed position toward the deployed position. In the intermediate position, the biasing element 220 is biased to provide a restoring force that assists the movement of the protection shield 116 away from the intermediate position whether the protection shield 116 is moved toward the deployed position or the stowed position.

With reference to FIG. 5C, continued rotation of the protection shield 116 in a direction from the intermediate position (FIG. 5B) toward the stowed position causes the second end 218 of the second link 214 to further pivot about the fourth pivot axis 231, such that the first end 216 is positioned below the second end 218. Such rotation of the second end 218 of the second link 214 also causes the first end 216 of the second link 214 to pivot about the third pivot axis 227 and the first link 208 to pivot about the second pivot axis 219 to account for the movement of the protection shield 116 to the stowed position. As the second link 214 is moved, the biasing element 220 is extended from the second, stretched position (FIG. 5B) to first, unstretched position (FIG. 5C). As the biasing element 220 is unstretched, the second end 234 of the biasing element 220 remains at the second slot end 230*b* of the bar 228 until the protection shield 116 is moved toward the deployed position.

It will be readily appreciated by those skilled in the art that various modifications, as indicated above, may be made to the disclosure without departing from the concepts disclosed in the foregoing description. Accordingly, the particular non-limiting examples or aspects described in detail herein are illustrative only and are not limiting to the scope of the disclosure, which is to be given the full breadth of the appended claims and any and all equivalents thereof.

What is claimed is:

1. A protective helmet comprising:

an outer shell configured for surrounding a head of a user;

a protection shield movable relative to the outer shell between a deployed position, where the protection shield extends forward of a front portion of the outer shell, and a stowed position, where the protection shield extends over an upper portion of the outer shell; and a linkage mechanism for connecting the protection shield to the outer shell and permitting movement of the protection shield between the deployed position and the stowed position, the linkage mechanism comprising:

a first link connected to the outer shell and the protection shield;

a second link having a first end connected to the outer shell and a second end connected to the protection shield; and a biasing member having a first end connected to the first link and a second end connected to the second link, wherein the second end of the biasing member slidably moves along the second link between the first end of the second link and the second end of the second link during movement of the protection shield between the deployed position and the stowed position, wherein the second link has a slot extending between the first end and the second end of the second link with a bar extending between a first slot end and a second slot end, wherein the second end of the biasing member is connected to the bar such that the biasing member moves along the bar between the first slot end and the second slot end during movement of the protection shield between the deployed position and the stowed position.

2. The protective helmet according to claim 1, wherein the slot is angled at an acute angle relative to a major longitudinal axis extending between the first end of the second link and the second end of the second link.

3. The protective helmet according to claim 1, wherein the slot is parallel with a major longitudinal axis extending between the first end of the second link and the second end of the second link.

4. The protective helmet according to claim 1, wherein the first end of the biasing member is a loop that is connected to a hook-shaped retaining element on the first link.

5. The protective helmet according to claim 4, wherein the first end of the biasing member pivots about the retaining element during movement of the protection shield between the deployed position and the stowed position.

6. The protective helmet according to claim 1, wherein the biasing member is movable between a first or unstretched configuration to a second or stretched configuration upon application of a biasing force to at least one of the first end of the biasing member and the second end of the biasing member due to movement of the protection shield to an intermediate position between the deployed position and the stowed position.

7. The protective helmet according to claim 6, wherein, in the second or stretched configuration, the biasing member provides assistance during movement of the protection shield from the intermediate position toward the deployed position or the stowed position.

8. The protective helmet according to claim 1, wherein the biasing member is a tension spring.

9. The protective helmet according to claim 1, wherein the first link is pivotally movable relative to the outer shell about a first pivot axis and wherein the first link is pivotally movable relative to the protection shield about a second pivot axis substantially parallel to the first pivot axis and offset from the first pivot axis.

10. The protective helmet according to claim 9, wherein the first end of the second link is pivotally movable relative to the outer shell about a third pivot axis and wherein the second end of the second link is pivotally movable relative to the protection shield about a fourth pivot axis substantially parallel to the third pivot axis and offset from the third pivot axis.

11. The protective helmet according to claim 1, further comprising a locking tab, wherein the first link and the first end of the second link are configured to be connected to the outer shell by the locking tab.

12. The protective helmet according to claim 11, wherein the locking tab has a rail that is shaped to be slidably received within an accessory attachment rail on a lateral portion of the outer shell.

13. The protective helmet according to claim 12, wherein the locking tab has a release button configured for releasing the locking tab from the accessory attachment rail.

14. A linkage mechanism for connecting a protection shield to an outer shell of a protective helmet, the linkage mechanism comprising:

a first link configured for connecting to the outer shell and the protection shield;

a second link having a first end configured for connecting to the outer shell and a second end configured for connecting to the protection shield; and a biasing member having a first end connected to the first link and a second end connected to the second link, wherein the second end of the biasing member is configured to slidably move along the second link between the first end of the second link and the second end of the second link during movement of the protection shield between a deployed position and a stowed position, wherein the second link has a slot extending between the first end and the second of the second link with a bar extending between a first slot end and a second slot end, wherein the second end of the biasing member is connected to the bar such that the biasing member is configured to move along the bar between the first slot end and the second slot end during movement of the protection shield between the deployed position and the stowed position.

15. The linkage mechanism according to claim 14, wherein the first end of the biasing member is a loop that is connected to a hook-shaped retaining element on the first link.

16. The linkage mechanism according to claim 14, wherein the biasing member is movable between a first or unstretched configuration to a second or stretched configuration upon application of a biasing force to at least one of the first end of the biasing member and the second end of the biasing member due to movement of the protection shield to an intermediate position between the deployed position and the stowed position.

* * * * *